US008382106B2

(12) United States Patent
Nöll

(10) Patent No.: US 8,382,106 B2
(45) Date of Patent: Feb. 26, 2013

(54) METHOD FOR SEPARATING AT LEAST TWO BRIDGES OF A SEGMENTED TRANSPORT SYSTEM FOR PRINTING MATERIALS, APPARATUS FOR IMPLEMENTING THE METHOD AND MACHINE FOR PROCESSING PRINTING MATERIALS

(75) Inventor: Matthias Nöll, Weiterstadt (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 887 days.

(21) Appl. No.: 12/497,722

(22) Filed: Jul. 6, 2009

(65) Prior Publication Data

US 2010/0064916 A1 Mar. 18, 2010

(30) Foreign Application Priority Data

Jul. 4, 2008 (DE) ..... 10 2008 031 734

(51) Int. Cl.
*B65H 5/00* (2006.01)
*B65H 29/04* (2006.01)

(52) U.S. Cl. ..... 271/264; 271/204; 271/206

(58) Field of Classification Search ..... 271/264, 271/198, 204, 206, 82
See application file for complete search history.

(56) References Cited

U.S. PATENT DOCUMENTS 3,771,463 A 11/1973 Smoot et al.
5,809,892 A 9/1998 Krüger et al.
6,044,760 A 4/2000 Krüger
6,089,158 A * 7/2000 Barroso ..... 101/232
6,092,801 A 7/2000 Abbadessa et al.
6,240,843 B1 6/2001 Krüger et al.
6,257,139 B1 * 7/2001 Schaede ..... 101/232
6,270,076 B1 * 8/2001 Reist ..... 271/302
6,631,901 B2 * 10/2003 Hess et al. ..... 271/205

(Continued)

FOREIGN PATENT DOCUMENTS

DE 2258492 6/1973
DE 3145263 A1 6/1983

(Continued)

OTHER PUBLICATIONS

European Search Report dated Oct. 26, 2009.

(Continued)

*Primary Examiner* — David H Bollinger
(74) *Attorney, Agent, or Firm* — Laurence A. Greenberg; Werner H. Stemer; Ralph E. Locher

(57) ABSTRACT

A method and apparatus for separating at least two bridges, especially gripper bars, of a segmented transport system for printing materials, e.g. sheets of paper in a printing press, include a transport system having a segmented electric linear drive with first and second primary parts constructed as segmented long-stator. The drive has a plurality of secondary parts constructed as carriages. Each secondary part assigned to the first primary part and each secondary part assigned to the second primary part are coupled by a crossmember to form a movable bridge. Two bridges in the same segment are moved jointly. A first bridge, reaching into a further segment due to jointly controlled movement, is moved individually under closed-loop control and separated from a second bridge, for locating the two bridges in different segments during further movement. Electrical and mechanical collisions of the bridges or of the carriages can therefore be eliminated.

10 Claims, 2 Drawing Sheets

U.S. PATENT DOCUMENTS

| | | | | |
|---|---|---|---|---|
| 6,923,119 | B1 * | 8/2005 | Frank | 101/232 |
| 7,347,416 | B2 * | 3/2008 | Diews et al. | 271/204 |
| 7,597,187 | B2 * | 10/2009 | Bausenwein et al. | 198/619 |
| 2002/0060409 | A1 | 5/2002 | Hess et al. | |

FOREIGN PATENT DOCUMENTS

| | | | |
|---|---|---|---|
| DE | 19722376 | A1 | 12/1997 |
| DE | 19821654 | A1 | 2/1999 |
| DE | 10141589 | A1 | 4/2002 |
| DE | 19748870 | C2 | 10/2002 |
| EP | 1529639 | A1 | 5/2005 |
| JP | 63099702 | A | 5/1988 |
| JP | 1264503 | A | 10/1989 |

OTHER PUBLICATIONS

German Search Report dated Jul. 4, 2008.

* cited by examiner

METHOD FOR SEPARATING AT LEAST TWO BRIDGES OF A SEGMENTED TRANSPORT SYSTEM FOR PRINTING MATERIALS, APPARATUS FOR IMPLEMENTING THE METHOD AND MACHINE FOR PROCESSING PRINTING MATERIALS

CROSS-REFERENCE TO RELATED APPLICATION

This application claims the priority, under 35 U.S.C. §119, of German Patent Application DE 10 2008 031 734.9, filed Jul. 4, 2008; the prior application is herewith incorporated by reference in its entirety.

BACKGROUND OF THE INVENTION

Field of the Invention

The present invention relates to a method for separating at least two bridges of a segmented transport system for printing materials, in which the transport system includes a segmented electric linear drive, the electric linear drive includes a first and a second primary part, each primary part is constructed as a segmented longitudinal stator, the electric linear drive has a plurality of secondary parts constructed as carriages, and in each case a secondary part assigned to the first primary part and a secondary part assigned to the second primary part are coupled by a crossmember and, together with the crossmember, form a movable bridge of the transport system. Such an arrangement is usually called a gantry system. Furthermore, the present invention relates to an apparatus for implementing the method, having a segmented transport system for printing materials, the transport system including a segmented electric linear drive, the electric linear drive including a first and a second primary part, each primary part being constructed as a segmented longitudinal stator, the electric linear drive having a plurality of secondary parts constructed as carriages, and in each case a secondary part assigned to the first primary part and a secondary part assigned to the second primary part being coupled by a crossmember and, together with the crossmember, forming a movable bridge of the transport system. Additionally, the present invention relates to a machine for processing printing material, for example a printing press, in particular a sheet-processing rotary printing press for lithographic offset printing or, for example, a further print processing machine.

In machines in the so-called graphic industry (prepress stage, print production and further print processing), printing materials, for example sheets of paper, board or film, are conveyed and processed, for example printed, varnished or punched. The in-register conveyance of the printing materials in such machines, for example in sheet-fed printing presses or sheet punches, is normally carried out through the use of rotating transport cylinders or linear drive systems. Suitable linear drive systems are, for example, chain conveyors or electric linear drives, which is to say systems in which a rotor or carriage moves along a stator in accordance with the dynamo-electrical interaction between the rotor and a magnetic field which travels along the stator.

Electric linear drives for the sheet transport firstly have, on one side of the machine, a so-called primary part (stator) and, secondly, in each case so-called secondary parts (rotors) in each case assigned to one of the two primary parts. In each case, two rotors are coupled to each other through a crossmember, with the crossmember being constructed as a gripper bar for the printing material. German Patent DE 197 48 870 C2, corresponding to U.S. Pat. Nos. 5,809,892; 6,044, 760; 6,092,801; and 6,240,843, describes a printing press having such an electric linear drive system.

Linear drive systems are normally constructed in segmented form, which means that the transport path is composed of a plurality of segments following one another. When the machine is switched off, it is possible for a problem to occur in which two or more gripper bars come to lie in one and the same segment of the linear drive system and then, when the machine is restarted, can no longer readily be moved individually under control. The same problem can occur when an emergency stop is carried out because of a disruption or when gripper bars are displaced manually during maintenance work. Such collided gripper bars must be divided or separated from one another again. However, manual separation requires a great deal of time and does not readily provide the necessary security of separation, which means that additional visual inspections are required.

German Published, Non-Prosecuted Patent Application DE 31 45 263 A1, which is not to be attributed to the graphic industry sector, describes the separation of workpieces (rods) which are moved forward by two segmented linear drives and are detected by switches. That separation operation is carried out by an individual piece being loosened from a bundle of workpieces by briefly switching over the traveling field direction and being picked up and transported away by an empty segment.

German Published, Non-Prosecuted Patent Application DE OS 22 58 492, corresponding to U.S. Pat. No. 3,771,463, likewise not to be attributed to the graphic industry sector, describes a pneumatic control system in which the speed and the spacing of vehicles from one another is maintained, with a guide being subdivided into control sections (stop blocks, slow blocks and fast blocks) and being provided with detectors. Patent Abstracts of Japan JP 63-99702 A describes a similar system for avoiding collisions of carriages of a linear drive. Patent Abstracts of Japan JP 01-264503 A describes a system for avoiding collisions in vertical transport paths with power interruption.

SUMMARY OF THE INVENTION

It is accordingly an object of the invention to provide a method for separating at least two bridges of a segmented transport system for printing materials, an apparatus for implementing the method and a machine for processing printing materials, which overcome the hereinafore-mentioned disadvantages of the heretofore-known methods and devices of this general type and which permit the reliable separation of at least two bridges of a segmented transport system for printing materials.

With the foregoing and other objects in view there is provided, in accordance with the invention, a method for separating at least two bridges of a segmented transport system for printing materials. The method comprises providing the transport system with a segmented electric linear drive having segments, providing the electric linear drive with a first and a second primary part, each primary part being constructed as a segmented long-stator providing the electric linear drive with a plurality of secondary parts constructed as carriages, coupling a respective secondary part assigned to the first primary part and a respective secondary part assigned to the second primary part with a respective crossmember to form a respective movable bridge of the transport system, jointly moving first and second bridges located in the same segment of the transport system under control, and individually moving the first bridge, reaching into a further segment as a result of the jointly controlled movement, under closed-loop control for separating the first bridge from the second bridge to locate the first and second bridges in different segments during a further movement.

The method according to the invention advantageously permits collided bridges, which is to say bridges that are located in one and the same segment when the machine is started up, to be separated or divided reliably from one another and then to be moved in closed-loop operation.

In accordance with another mode of the method of the invention that is advantageous and therefore preferred with regard to a shortened separation time, the first bridge is accelerated during the separation and is thus separated more quickly from the second bridge.

In accordance with a further mode of the method of the invention that is advantageous and therefore preferred for the reliable separation, during the separation, the first bridge is moved into a segment in which there is no further bridge.

In accordance with an added mode of the method of the invention that is likewise advantageous and therefore preferred for the reliable separation, the two bridges are aligned before the separation, which is to say that a relative spacing in the direction of movement between the two carriages of a bridge is reduced or eliminated.

In accordance with an additional mode of the method of the invention that is advantageous and therefore preferred for the reliable separation, the two bridges are synchronized before the separation, which is to say that the two carriages of a bridge are disposed in accordance with a grid of a pole pair configuration.

With the objects of the invention in view, there is also provided an apparatus for separating at least two bridges of a segmented transport system for printing materials. The apparatus comprises a segmented printing material transport system including a segmented electric linear drive. The electric linear drive has a first and a second primary part, each primary part being constructed as a segmented long-stator. The electric linear drive has a plurality of secondary parts constructed as carriages. Crossmembers each couple a respective secondary part assigned to the first primary part and a respective secondary part assigned to the second primary part to form a respective movable bridge. A separating device constructed as a control and regulating device controls and/or regulates a movement of the bridges individually to separate collided bridges and implement the method according to the invention.

The apparatus according to the invention advantageously permits collided bridges, which is to say bridges that are located in one and the same segment when the machine is started up, to be separated or divided reliably and then moved in closed-loop operation.

With the objects of the invention in view, there is concomitantly provided a machine for processing printing material, for example a printing press, in particular a sheet-processing rotary printing press for lithographic offset printing or, for example, a further print processing machine. The machine comprises an apparatus for separating at least two bridges of a segmented transport system for printing materials, according to the invention.

The invention which is described and the advantageous developments of the invention that are described also constitute advantageous developments of the invention in combination with one another. One advantageous combination is constituted, for example, by a method in which the bridges are first aligned, then synchronized, then separated and then moved in normal operation.

Other features which are considered as characteristic for the invention are set forth in the appended claims.

Although the invention is illustrated and described herein as embodied in a method for separating at least two bridges of a segmented transport system for printing materials, an apparatus for implementing the method and a machine for processing printing materials, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

The invention as such and structurally and/or functionally advantageous developments of the invention will be described in more detail below with reference to the associated drawings and by using at least one preferred exemplary embodiment. In the drawings, mutually corresponding elements are provided with the same designations in each case.

DETAILED DESCRIPTION OF THE INVENTION

Apparatus

Figure 1:
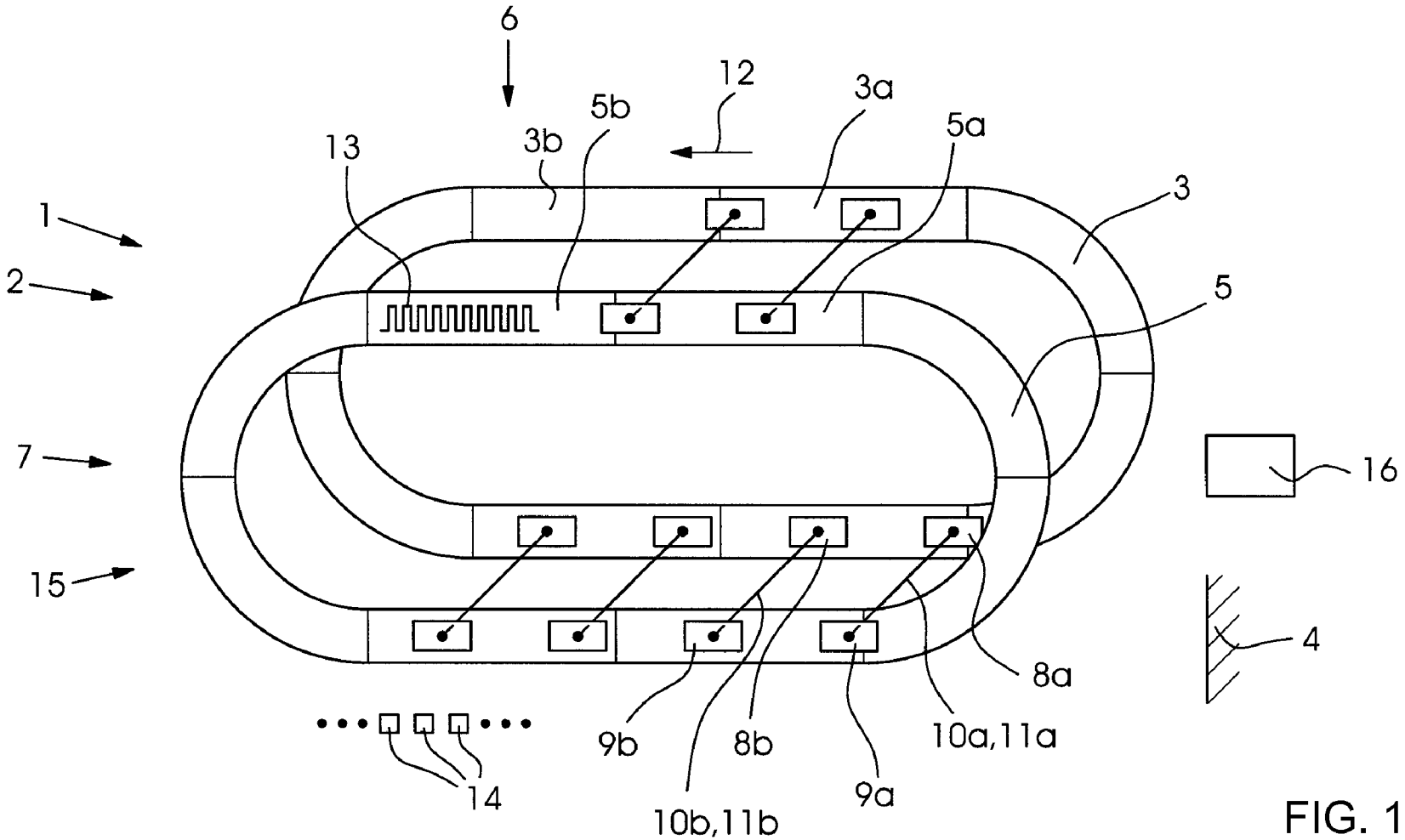
FIG. 1 is a diagrammatic, perspective view of a preferred exemplary embodiment of a transport system according to the invention.

Referring now to the figures of the drawings in detail and first, particularly, to FIG. 1 thereof, there is seen a diagrammatic, perspective view of a preferred exemplary embodiment of a transport system 1 according to the invention for printing materials, for example sheets of paper, board or film, having a segmented electric linear drive 2. The electric linear drive 2 includes a first primary part 3 (long-stator), for example on the so-called drive side AS of a machine 4 for processing printing material, and a second primary part 5 (long-stator), for example on the so-called operating side BS of the machine 4. Each primary part 3, 5 is built up from a plurality of (long-stator) segments 3*a*, 3*b*, etc. and 5*a*, 5*b*, etc. together forming a closed path. The closed path in this case has both at least one straight section 6 and one curved section 7.

Furthermore, the electric linear drive 2 includes movable secondary parts 8 (translators), which are formed as carriages 8*a*, 8*b*, etc. and 9*a*, 9*b*, etc. Each two carriages 8*a*/9*a*, 8*b*/9*b*, etc., one being assigned to the first primary part 3 and the other to the second primary part 5, are coupled through a crossmember 10*a*, 10*b*, etc., in particular a gripper bar for the printing material and, together with the crossmember 10, form a so-called bridge configuration 11*a*, 11*b*, etc. (abbreviated as bridge). FIG. 1 additionally shows a primary direction of movement 12 of the bridges 11 and of the carriages 8, 9.

A transport system 1 according to the invention can preferably be disposed within a printing press 4, for example a sheet-processing lithographic rotary printing press, or a further print processing machine 4, for example a die cutting machine.

The stator, which is to say each primary part 3, 5, is formed by successive poles 13 (coil formers with windings), in each case two successive poles 13 forming a pole pair. The (overall) length in the direction of movement of two poles 13 and two pole spacings is designated as the pole pair length. The magnet wheel angle Θ is defined as follows: 360° corresponds to the length of a pole pair or the pole pair length.

In order to regulate the bridges 11 individually in accordance with predefined intended positions, the position of each carriage 8, 9 is registered individually and the motor current or the forward thrust on each secondary part 8, 9 is predefined individually. Diverse non-encoder methods and position sensors 14 are provided for the measurement of the position. In order to be able to predefine the forward thrust force on each secondary part 8, 9 individually, the stator is segmented electrically with stator segments 3, 5 which can be activated individually (by a control and regulating device 15) and which are constructed in such a way that, in normal operation, at any time during the control, all of the secondary parts 8, 9 are located in different stator segments 3, 5.

In normal operation, there is at most one bridge 11 in each segment 3, 5. When the machine 4 is switched off, in the event of a stoppage for a fault or in the event of manual displacement of bridges 11, for example during maintenance work, it is however possible for two or more bridges 11 to be located wholly or partly in one segment 3, 5 of the linear drive 2. If two or more secondary parts 8, 9 are located wholly or partly in the same segment 3, 5, then the motor current of the segment 3, 5 exerts a force on all of these secondary parts 8, 9, so that the secondary parts 8, 9 and therefore also the relevant bridges 11 cannot be regulated independently of one another. This exceptional case is designated as an electrical collision. The electrically collided bridges 11 cannot be started up independently of one another under control. The invention deals with the separation of electrically collided (if appropriate, even mechanically collided) bridges 11, which is to say with starting up such bridges 11 until normal operation.

Method

Figure 2:
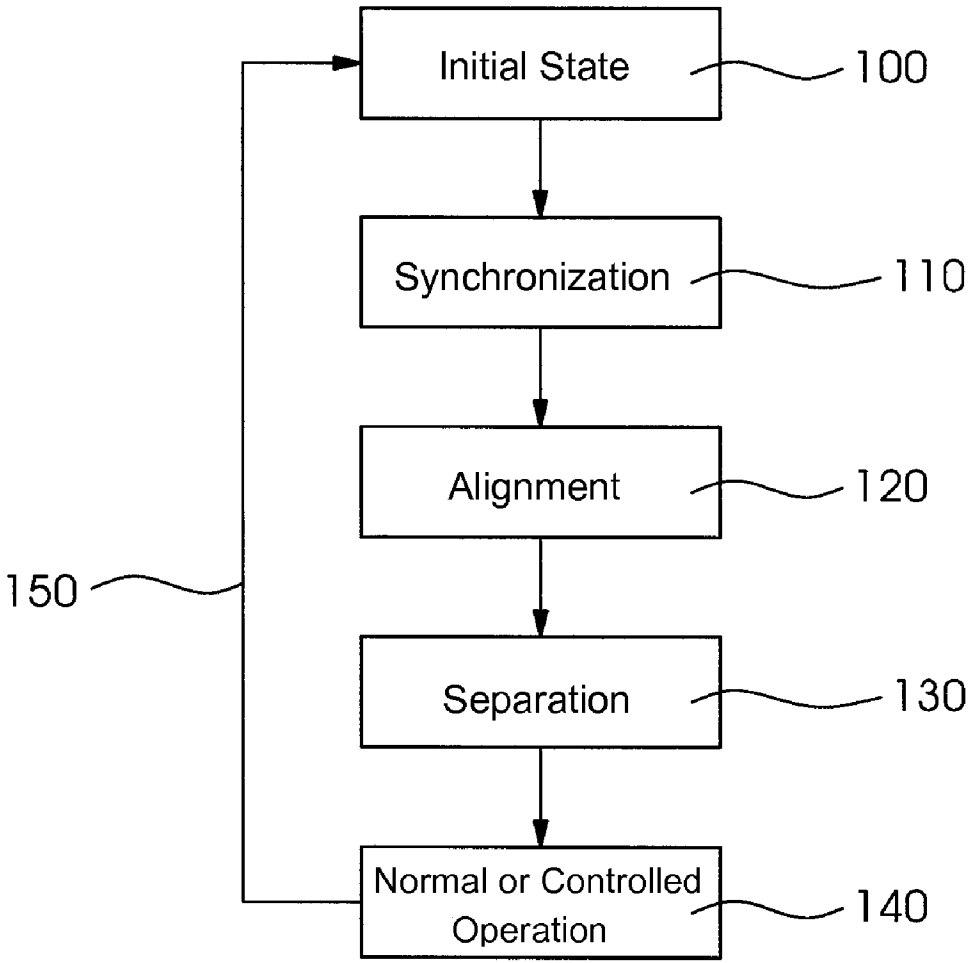
FIG. 2 is a flowchart of a preferred exemplary embodiment of a method according to the invention.

FIG. 2 shows a flowchart of a preferred exemplary embodiment of a method according to the invention. The individual method steps will be listed and explained below.

Initial State (Method Step 100)

A) Principle

The method starts with method step 100 (initial state), in which all the bridges 11 are at a standstill, for example when switching on or restarting the machine 4 after a stoppage for a fault or maintenance intervention. The individual bridges 11 can be at an angle in the initial state and/or collide electrically (or even mechanically). Furthermore, their positions may be unknown, in particular when they have been displaced manually.

B) Details

The intended positions of the bridges 11 in controlled operation or normal operation following the conclusion of a transition phase (see below: alignment, synchronization, separation) can be calculated as static functions from a virtual master shaft or guiding or leading front axle. These intended positions, calculated from the static functions, are designated reference positions xRef(B,S), in order to distinguish them from the current intended positions xW(B,S). The variable B in this notation designates the number of the bridge 11, the variable S the side AS or BS of the bridge 11. The matrices xRef and xW thus contain individual values for each carriage 8, 9.

In the initial state, the actual positions x(B,S) of the bridges 11 can typically deviate highly from the reference positions xRef(B,S) calculated in this way. If the closed-loop control were then started with the reference positions xRef(B,S), the result would then be abrupt excitations of the bridges 11, with corresponding loading of the mechanism. In the preferred embodiment of the invention, the intended positions xW(B,S) are therefore transformed into the reference positions xRef (B,S) given by the static function through the use of more gentle transitions, starting from the actual positions x(B,S).

The virtual master shaft or guiding or leading front axle can, in principle, begin at any desired magnet wheel starting angle. In order to choose the transition processes to be as short as possible, in the preferred embodiment the rotor starting angle is calculated from the static inverse function or the static inverse functions from the actual positions x(B,S) of the carriages 8, 9 of one or more bridges 11.

Synchronization (Method Step 110)

A) Principle

So-called synchronization is carried out in a method step 110. In this case, through the use of the position sensors 14 for the bridges 11, a check is first made to see whether there are electrical (or even mechanical) collisions and where, which is to say in which stator segments 3*a*, 3*b*, etc. and 5*a*, 5*b*, etc. Then, at least the carriages 8, 9 of those bridges 11 which collide electrically are moved along a transport path 15 to a position defined by the pole pair configurations 13 and the spacing of the stator by increasing the motor current of the relevant stator segments 3*a*, 3*b*, etc. and 5*a*, 5*b*, etc. at a predefined magnet wheel angle Θ. In other words, the carriages 8, 9 are then not located "anywhere" along the transport path 15 but exactly on the "grid" of the transport path 15.

B) Details

In this case, the motor current corresponds to the force-forming current of a field-oriented control system, which leads to a force on the secondary parts 8, 9 that is approximately proportional to the motor current. If a three-phase synchronous motor is used, this current is converted into suitable phase currents in the stator segment 3*a*, 3*b*, etc. and 5*a*, 5*b*, etc. through the use of field-oriented closed-loop control and frequency converters.

In the simplest case, the magnet wheel angle Θ during synchronization is the same in all of the segments affected by the synchronization and is chosen as a fixed value. The predefined magnet wheel angle determines the synchronization position only within one pole pair 13. Therefore, under unfavorable circumstances, it is possible for the secondary parts of a bridge 11 to be pulled during synchronization to different positions at a distance of one pole pair 13 or, depending on the mechanical structure, possibly also a plurality of pole pairs 13. Therefore, in the preferred embodiment, during synchronization the relative position of the secondary parts of a bridge 11 which belong to the same bridges 11 affected by the synchronization are monitored in the direction of movement.

If the maximum permissible relative position during the synchronization is reached as the current is increased, or if the distance of the carriages 8, 9 of a bridge 11 is enlarged sharply during synchronization instead of being reduced, the synchronization is aborted.

Since the secondary parts have been moved somewhat by the synchronization attempt, the initial conditions have therefore also changed. The probability that, during a plurality of synchronization attempts, the secondary parts of a bridge 11 are repeatedly moved apart instead of toward each other, is therefore considerably lower than it already is in any case during a single attempt. In the simplest case, after an unsuccessful synchronization attempt, it is therefore possible to begin with a renewed synchronization attempt.

In order to increase the probability of successful synchronization, in an alternative embodiment the magnet wheel angle Θ during synchronization can if appropriate also be calculated individually for each stator segment, in such a way that the synchronization position lies in the vicinity of the current positions or that in no secondary part does the current position lie in the vicinity of the center between two synchronization positions. If the same magnet wheel angle Θ is not chosen for all of the stator segments during synchronization, care must be taken to ensure that it is at least the same for successive segments in the event that a secondary part is partly located in both segments.

As a result of the synchronization, the carriages 8, 9 of the bridges 11 are initially separated mechanically (i.e. mechanical collisions are eliminated). They can then be activated in a controlled manner (by the control and regulating device 15). However, there can still be electrical collisions, in which the carriages 8, 9 cannot be activated individually.

Alignment (Method Step 120)

A) Principle

In a method step 120, the alignment of the bridges 11 is carried out. In the process, a possible relative spacing (in the direction of movement) of the two carriages 8, 9 of each bridge 11 in relation to one another is reduced, preferably eliminated. In other words: the bridges 11 are no longer at an angle to the primary parts 3, 5 but are perpendicular.

B) Details

Since one constraint resides in limiting the relative position $|x(B,AS)-x(B,BS)|$ of the carriages 8, 9 of a bridge 11, during the transition firstly the intended positions xW(B,AS) and xW(B,BS) (possibly apart from a low predefined intended relative position $\Delta=xRef(B,BS)-xRef(B,AS)$) are equalized. After that, the equalized intended positions $xW(B,BS)=xW(B,AS)+\Delta$ are transferred to the reference positions given by the static functions $xRef(B,BS)=xRef(B,AS)+\Delta$.

If the mechanical structure of the system 1 permits, however, the transitions of the intended positions of the carriages 8, 9 of a bridge 11 can also be made directly from the actual positions x(B,S) to the reference positions xRef(B,S) without previous equalization.

Separation (Method Step 130)

A) Principle

In a method step 130, the separation of electrically colliding bridges 11 and the associated carriages 8, 9 is carried out. To this end, two bridges 11 (the first and second bridge) which are located in the same segment of the transport system 1 are jointly moved forward (alternatively: rearward) under open-loop control.

Both the bridges 11 are thus set moving and the leading (alternatively: trailing) first bridge 11 in the direction of movement reaches a further segment of the transport system 1, in which segment there is no further bridge 11 at this time, on the basis of this jointly controlled movement.

The first bridge 11 is then no longer controlled jointly with the second bridge 11 but moved individually under closed-loop control, in particular accelerated, and as a result is separated from the other, second bridge 11, so that the two bridges 11 are always located in different segments during the further movement.

Provided that no further bridges 11 are located in the same segment, the second bridge 11 is then likewise moved individually under closed-loop control or—if there are still one or more bridges 11 in the same segment—is moved onward jointly together with them under open-loop control until (like the first bridge 11 previously) it reaches a further segment in which there are no further bridges 11, and only then is moved individually under closed-loop control and thus likewise separated.

Consequently, a sequence of electrically colliding bridges 11 can be separated successively, in that in each case the foremost (alternatively: rearmost) bridge 11 changes to closed-loop operation as a result of "separation" from the sequence, which is to say through the use of individually regulated movement instead of jointly controlled movement. As soon as all of the bridges 11 of all of these sequences of electrically colliding bridges 11 have been separated, the transport system 1 can be transferred to operation or normal operation under closed-loop control.

B) Details

During the transition phase, in the preferred embodiment, only non-negative speeds $dxW(B,S)/dt \geqq 0$ are permitted in the actual intended values xW(B,S) and the traveling field of the synchronous operation, so that the bridges 11 do not move rearwards and the rear carriage 8 or 9 of a bridge 11 initially catches up with the front carriage 9 or 8, respectively (if appropriate, apart from a predefined intended relative position Δ). If the reference position xRef(B,S) calculated from the static functions lies behind the actual position x(B,S), the actual intended position xW(B,S) in the preferred embodiment remains at the actual position x(B,S) which this carriage 8, 9 occupied at the start of the closed-loop control.

Equally well, however, only negative speeds can also be permitted during the separation, so that all of the bridges 11 move only rearward. In addition, the restriction of the direction of travel could be restricted only to the segments in which electrical collisions occur or would arise as a result of moving secondary parts out rearward from a stator segment.

In the stator segments in which an electrical collision occurs and, possibly, also in the corresponding stator segments of the other side, following the synchronization a sufficiently high motor current is predefined and the magnet wheel angle Θ is increased in such a way that the secondary parts are moved forward. This corresponds to open-loop operation in these segments, through which the secondary parts move forward under open-loop control at the position. As already mentioned above, rearward travel would likewise also be possible for the purpose of separation with a reduction in the magnet wheel angle Θ.

If the magnet wheel angle Θ of the two sides was predefined differently during synchronization, because, according to the alternative embodiment, this leads to synchronization positions which lie closer to the initial actual positions, when rearward travel is suppressed the magnet wheel angles Θ belonging to positions located further toward the rear are changed to those of the other side. Since, as a result of the bridge structure, the positions of the two sides can differ only little, the angular change can be carried out slowly without lasting too long.

If, during the increase in the magnet wheel angle Θ in open-loop operation, the resultant acceleration of the secondary parts becomes too high, the tilting force of the linear synchronous drive can be exceeded and the motor can get out of step. In order to avoid this, in the preferred embodiment changes in the magnet wheel angle Θ are carried out with acceleration limited (the magnitude of the maximum acceleration of the secondary parts is limited) and possibly jerk limited (the magnitude of the change in the acceleration of the secondary parts over time is limited).

The higher the motor current is chosen to be in open-loop operation, the higher the tilting force is as well and therefore the permissible maximum acceleration. As soon as the secondary parts of the bridge 11 in open-loop operation have been moved out of a stator segment with electrical collision into a following, free stator segment, they can be closed-loop controlled individually. They are then able to follow a calculated intended position xW(B,S), which describes a transition between the actual position x(B,S) and the reference position xRef(B,S) calculated from the master shaft or guiding or leading front axle in accordance with the static function. As soon as the penultimate secondary part has been moved out of a stator segment with electrical collision, this segment is free of electrical collisions and the last secondary part can likewise be closed-loop controlled individually and follow an intended value xW(B,S).

As a result of the synchronization described with subsequent open-loop operation, electrical collisions are resolved. However, there is therefore always still the risk that new electrical collisions will arise by secondary parts moving into stator segments in which there are already other secondary parts. In the preferred embodiment of the method, the occurrence of new electrical collision is reliably avoided by a secondary part stopping at the end of a stator segment, which is to say before it begins to move into the following segment, if there is already at least one secondary part in the following segment. In the preferred embodiment, a carriage 8, 9 additionally also stops when the distance from the vehicle traveling in front falls below a minimum.

If there is at least one carriage 8, 9 in the segment after the next, given a sufficiently large choice of the minimum distance, travel into a very short stator segment which is shorter than the stopping distance can therefore also be avoided. In segments with open-loop operation, the stopping is carried out through the use of acceleration and possibly jerk limited reduction in the speed of the magnet wheel angle Θ down to a standstill. In segments without electrical collision, through the use of appropriate, suitable predefinition of the intended position xW(B,S) of the secondary part which, as a result, interrupts the transition to the reference value xRef(B,S) calculated as a static function.

The stopping must be initiated in good time such that the stopping travel ends reliably before traveling into the next segment. Taking into account the maximum permitted magnitude of the acceleration and the maximum permitted magnitude of the jerk, the result is the maximum permitted speed for the intended value change in controlled operation during the transition phase, taking into account the motor current in open-loop operation and the tilting force resulting therefrom as well as the maximum permitted speed of the magnet wheel angle Θ in the segments with electrical collision.

Since, in stator segments with open-loop operation, the secondary parts can follow one another very closely, when a secondary part has moved completely out of the segment, the following secondary part can already be located very closely before the following stator segment, so that only a very small stopping travel would be available. In order to maintain the stopping travel, the speed during open-loop operation would have to be chosen to be only very low, so that the separation could be carried out only very slowly.

In order to increase the available stopping travel, the preferred method provides for the secondary parts moving out of the stator segment with open-loop operation to be closed-loop controlled through the motor current of the following segment even if they are only partly located therein, for example by at least 50%. Then, through their proportion which is still located in the region of the segment with open-loop operation, the already closed-loop controlled secondary parts experience a force which can be interpreted as a interference disturbance which acts against the closed-loop control. The course of this disturbance can also be calculated from motor constant (proportionality factor between force and current), magnet wheel angle Θ, carriage position and motor current and feedforward controlled in the sense of a disturbance feedforward through the motor current of the segment without electrical collision.

In order to avoid mutual blocking and inconsistent magnetic fields during the travel of a carriage 8, 9 from one stator segment with open-loop operation into the following stator segment with open-loop operation, in the preferred embodiment the stopping in a segment with electrical collision is suppressed if an electrical collision likewise occurs in the following segment.

Normal or Controlled Operation (Method Step 140)

As soon as all of the intended positions xW(B,S) have been transferred into the reference positions xRef(B,S) given by the static functions of the virtual master shaft or guiding or leading front axle, the transition phase has been completed and the normal operation or controlled operation 140 can begin. Following a stoppage of the machine 4 or the like, the method according to the invention can begin again at method step 100 (circular process 150).

Collision Prevention

During the transition until normal operation with xW(B,S) =xRef(B,S) is reached, the intended values xW(B,S) deviate from the reference values xRef(B,S) calculated from the virtual master shaft or guiding or leading front axle through static functions. In the areas of processing stations or, in general, areas in which machine parts project into the travel path at specific angles of the virtual master shaft or guiding or leading front axle, there can be the risk of collisions between the bridges 11 and the machine parts reaching into the travel path because of the lack of coupling between virtual master shaft or guiding or leading front axle and intended value xW(B,S). In the preferred embodiment of the method, before starting up and during the transition phase until normal operation is reached, processing tools in the stations or other machine parts are therefore moved into a position in which a collision with the linearly driven parts of the machine 4 is ruled out.

Parking

In the de-energized state, the force of gravity can induce the bridges 11 in regions with a vertical directional component (for example in the curved region 7) to slip downward and thus assume an uncontrolled state. When the machine 4 is switched off, bridges 11 that slip downward can firstly collide with other bridges 11 located there (which could damage the mechanism as a result of shocks) and secondly could lead to electrical collisions when restarting the machine 4. In order to avoid this, the method provides that, before switching off the control of bridges 11 which are located in regions with a vertical direction component, the bridges 11 are moved into a parking position, in which no electrical collision occurs, nor any vertical directional component. In the preferred embodiment of the method, in addition the entry of bridges 11 into the respective first stator segments 3*a*, 3*b*, etc., 5*a*, 5*b*, etc. in regions with a vertical directional component or alternatively into stator segments located before them is suppressed. Also possible, but more complicated, is the individual pre-definition of explicit stopping positions. If, as illustrated in FIG. 1, there are more carriages 8, 9 than segments 3*a*, 3*b*, etc., 5*a*, 5*b*, etc., without a vertical directional component, the method provides for the carriages 8, 9 to be moved in a controlled manner at the spacing of a whole number of pole pairs 13 into a open-loop controlled horizontal segment 3*a*, 3*b*, etc., 5*a*, 5*b*, etc. or else a plurality of segments 3*a*, 3*b*, etc., 5*a*, 5*b*, etc., before the segments 3*a*, 3*b*, etc., 5*a*, 5*b*, etc. are switched off.

Alternatives

An alternative method would be, for example, to have the bridges 11 in open-loop operation move or be pushed into a non-energized segment 3*a*, 3*b*, etc., 5*a*, 5*b*, etc., until all of the bridges 11 are standing one after another with mechanical contact. After that, in very slow open-loop operation, the successive bridges 11 could then be moved out again at the end of these segments 3*a*, 3*b*, etc., 5*a*, 5*b*, etc. and, beginning from the following segment, could be closed-loop controlled individually and accelerated sharply. This method would be simpler than the preferred embodiment but not operating in parallel and therefore slower. In addition, as a result of the mechanical contact between successive carriages 8, 9, it would be less controlled.

It would also alternatively be possible to imagine a mechanical separating apparatus which separates the carriages 8, 9 mechanically, in that, for example, in open-loop operation it allows only the first carriage to move onward into a segment 3*a*, 3*b*, etc., 5*a*, 5*b*, etc., but blocks the onward travel of further carriages through the use of a mechanical barrier until the first carriage has moved out of the segment. However, this would be more complicated than the preferred embodiment, since in addition a mechanical separating apparatus would be required. In addition, this method would also be slower, since the carriages 8, 9 would first have to travel to the mechanical separating apparatus.

The method according to the invention could also be applied in simplified form in long-stator linear synchronous motor applications without any bridge configuration. The synchronization is then non-critical and the equalization of the carriages 8, 9 on the two sides is dispensed with although the method steps including initial state, synchronization, control/of the transition from actual to reference value, open-loop operation and, finally, avoiding new electrical collisions, remain in their basic function.

Apparatus

A further partial aspect of the invention relates to the apparatus. In the preferred embodiment, the length of the carriages 8, 9 carrying the secondary parts is chosen such that it lies between an odd-numbered multiple and the following even-numbered multiple of the pole length of the stator 3, 5. This condition is maintained both in the straight region 6 and in any curved region 7 that may be present, which further restricts the permissible length range. In this case, length means the mechanically effective length, which predefines the minimum spacing between the same points of successive carriages 8, 9, for example the centers of gravity of the secondary parts 8, 9. The length is therefore normally greater in the curves 7 than in the straight region 6. In this preferred embodiment, carriages 8, 9 following one another directly are also separated during synchronization instead of being pushed together, which is a precondition for the reliable achievement of the intended synchronization position. If the condition is not satisfied, carriages 8, 9 following one another directly can be pushed together following synchronization, so that, during the subsequent open-loop operation, in particular during the transition from the straight region 6 to the curved region 7, it is not possible for uncontrollable jumps to occur. On the other hand, if the condition is satisfied, even carriages 8, 9 following one another directly (i.e. without interspaces) are separated by interspaces as a result of the synchronization.

Furthermore, in the preferred embodiment, the secondary parts 8, 9 and stators 3, 5 of both sides are constructed with mirror symmetry and the magnet wheel angles Θ of the stator segments 3*a*, 3*b*, etc., 5*a*, 5*b*, etc. of both sides are predefined to be the same during synchronization and open-loop operation. This reduces the risk that the carriages 8, 9 of a bridge 11 are pulled to different synchronization positions because of different conditions on the two sides and the synchronization therefore fails. In principle, however, successful synchronization is also possible in the case of a non-mirror-symmetrical structure of the two sides. In an alternative embodiment, the magnet wheel angles Θ predefined for the synchronization are then chosen such that they correspond to the same synchronization positions. For instance, if the stator segments 3*a*, 3*b*, etc., 5*a*, 5*b*, etc. of the two sides are constructed with mirror symmetry but the configuration of the poles 13 of the secondary part 8, 9 on the two sides is inverted, then a rotor angle Θ differing by 180° then leads to the same synchronization position on both sides.

The invention claimed is:

1. A method for separating at least two bridges of a segmented transport system for printing materials, the method comprising the following steps:

providing the transport system with a segmented electric linear drive;

providing the electric linear drive with a first and a second primary part, each primary part being constructed as a segmented long-stator;

providing the electric linear drive with a plurality of secondary parts constructed as carriages, coupling a respective secondary part assigned to the first primary part and a respective secondary part assigned to the second primary part with a respective crossmember to form a respective movable bridge of the transport system;

jointly moving first and second bridges located in the same segment of the transport system under open-loop control; and individually moving the first bridge, reaching into a further segment as a result of the jointly open-loop controlled movement, under closed-loop control for separating the first bridge from the second bridge to locate the first and second bridges in different segments during a further movement.

2. The method according to claim 1, which further comprises accelerating the first bridge during the separating step.

3. The method according to claim 1, which further comprises moving the first bridge into a segment in which there is no further bridge, during the separating step.

4. The method according to claim 1, which further comprises aligning the first and second bridges before the separating step, for reducing or eliminating a relative spacing in a direction of movement between two carriages of a bridge.

5. The method according to claim 1, which further comprises synchronizing the first and second bridges before the separating step, for locating two carriages of a bridge in accordance with a grid of a pole pair configuration.

6. An apparatus for separating at least two bridges of a segmented transport system for printing materials, the apparatus comprising:

a segmented printing material transport system including a segmented electric linear drive;

said electric linear drive having a first and a second primary part, each primary part being constructed as a segmented long-stator;

said electric linear drive having a plurality of secondary parts constructed as carriages;

crossmembers each coupling a respective secondary part assigned to said first primary part and a respective secondary part assigned to said second primary part to form a respective movable bridge; and a separating device constructed as a control and regulating device for open-loop and/or closed-loop controlling a movement of said bridges individually to separate collided bridges and implement the method according to claim 1.

7. A machine for processing printing material, the machine comprising an apparatus for separating at least two bridges of a segmented transport system for printing materials, the apparatus including:

a segmented printing material transport system including a segmented electric linear drive;

said electric linear drive having a first and a second primary part, each primary part being constructed as a segmented long-stator;

said electric linear drive having a plurality of secondary parts constructed as carriages;

crossmembers each coupling a respective secondary part assigned to said first primary part and a respective secondary part assigned to said second primary part to form a respective movable bridge; and a separating device constructed as a control and regulating device for open-loop and/or closed-loop controlling a movement of said bridges individually to separate collided bridges and implement the method according to claim 1.

8. The machine according to claim 7, wherein the machine is a printing press.

9. The machine according to claim 8, wherein the machine is a sheet-processing rotary printing press for lithographic offset printing.

10. The machine according to claim 8, wherein the machine is a further print processing machine.

* * * * *